United States Patent [19]

Nelson

[11] Patent Number: 4,955,496

[45] Date of Patent: Sep. 11, 1990

[54] REFUSE BAG STABILIZER

[76] Inventor: Stanford C. Nelson, 8 S. Merrill Ave., Park Ridge, Ill. 60068

[21] Appl. No.: 386,347

[22] Filed: Jul. 28, 1989

[51] Int. Cl.[5] ..... A65D 25/14

[52] U.S. Cl. ..... 220/1 T; 220/402; 220/403; 141/316

[58] Field of Search ..... 220/1 T, 402, 403, 470; 141/316

[56] References Cited

U.S. PATENT DOCUMENTS

| | | | |
|---|---|---|---|
| 3,762,599 | 10/1973 | Bourgeois | 220/402 |
| 3,915,329 | 10/1975 | Zaks | 220/402 X |
| 4,054,225 | 10/1977 | Frech | 220/403 X |
| 4,254,602 | 3/1981 | Boynton | 220/1 T X |
| 4,628,007 | 12/1986 | Ledsham | 220/1 T X |
| 4,749,011 | 6/1988 | Rylander | 220/402 X |
| 4,762,297 | 8/1988 | Milligan . | |
| 4,765,579 | 8/1988 | Robbins, III et al. . | |
| 4,842,228 | 6/1989 | Kasper | 220/1 T X |

OTHER PUBLICATIONS

Page 55 from the "Brookstone Hard-To-Find Tools", catalog, Peterborough, New Hampshire, Fall 1988.

*Primary Examiner*—Steven M. Pollard

*Attorney, Agent, or Firm*—Hill, Van Santen, Steadman & Simpson

[57] ABSTRACT

A liner for bags comprising a panel member adapted to form a roll insertable into a bag, the panel including means for securing together overlapped and overlapping portions while permitting selective sizing of the diameter of a cylinder formed by the rolled up panel.

18 Claims, 2 Drawing Sheets

FIG. 1
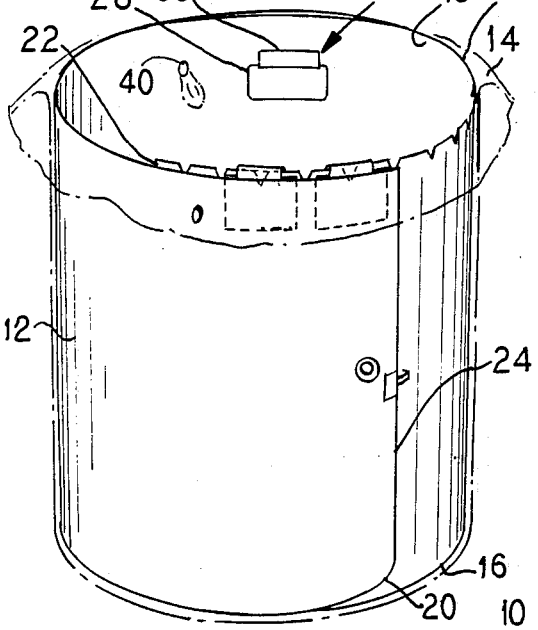
FIG. 2
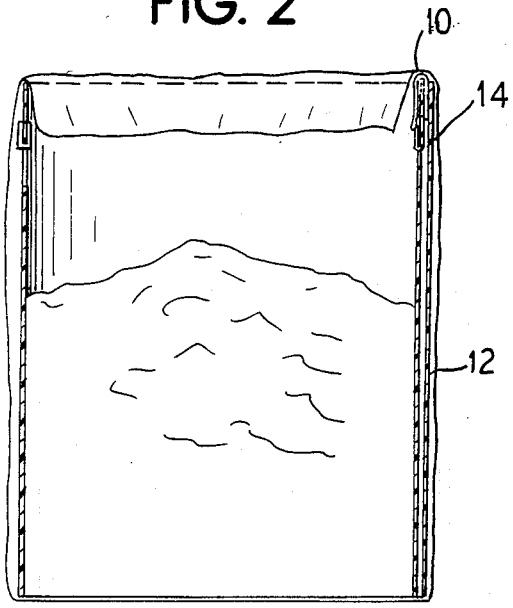
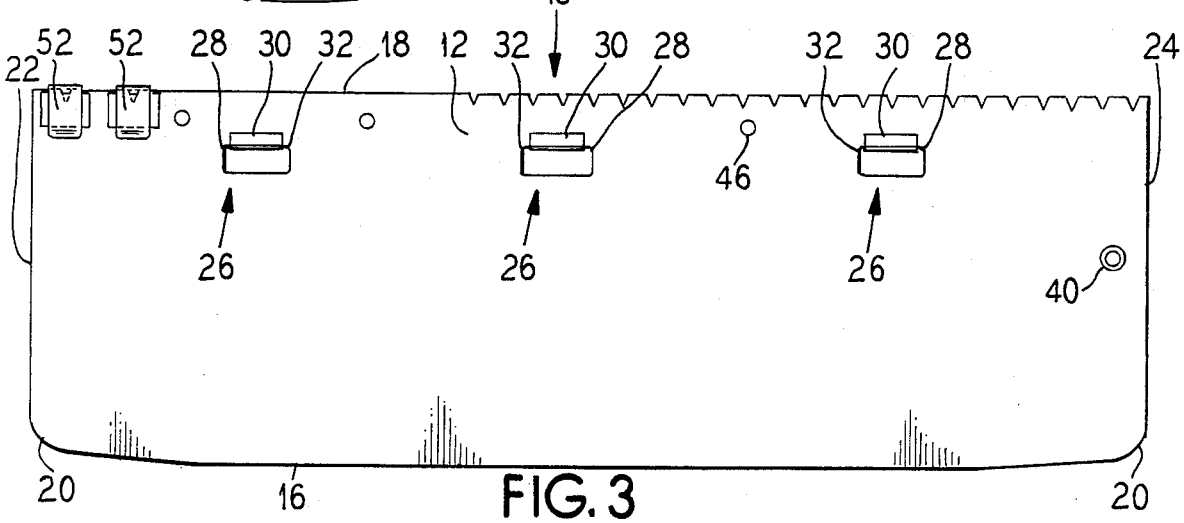
FIG. 3
FIG. 4
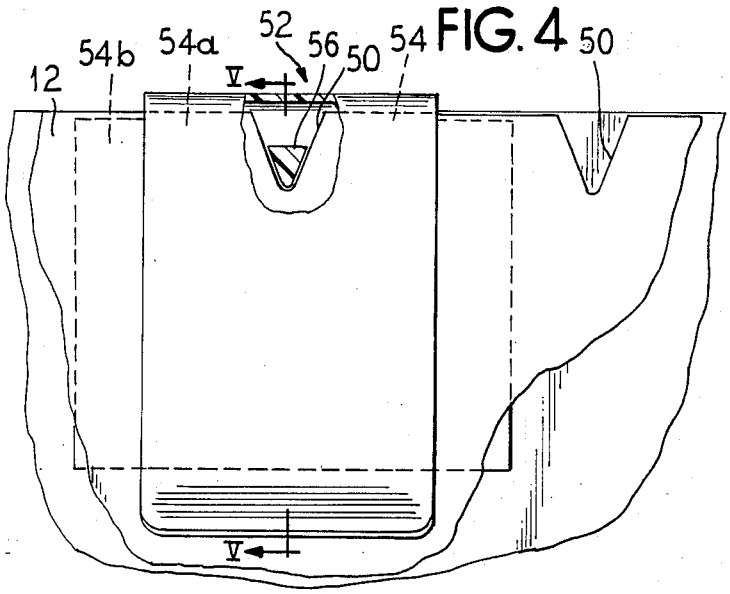
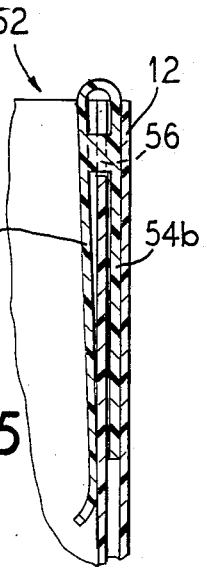
FIG. 5

REFUSE BAG STABILIZER

BACKGROUND OF THE INVENTION

The present invention generally relates to liners for stabilizing bags. More specifically, the invention relates to a plastic liner that is employed to impart rigidity to a plastic bag during filling of same.

Most bags, particularly plastic bags, are not sufficiently rigid to retain an opened and upstanding shape on their own. Instead, these bags collapse unless supported by some sort of stabilizing means. For example, wire frames are employed in grocery stores for hanging plastic bags by their handles.

In a more relevant instance, a bag supporting liner is disclosed at page 55 of a Fall, 1988 catalogue produced by a national retailer, Brookstone Company, Inc. This liner comprises a sheet of plastic that rolls up to form a tube or cylinder. The rolled-up plastic sheet is inserted into a standard trash bag to provide support so that the bag will stand up and stay open. The natural resiliency of the plastic sheet biases the sheet to an unrolled state and expands within the bag to the extent permitted by the size of the bag.

With the liner inserted into a bag, the bag can then be filled with trash, grass clippings, i.e., et cetera. The liner protects the bag from ripping and punctures.

The advertised liner expands up to 22 inches in diameter and stands 30 inches high. The liner includes handle openings at a top edge thereof for grasping so that once a bag is filled, the liner can be removed from the bag simply by lifting the liner out of the bag.

SUMMARY OF THE INVENTION

The present invention provides an improved stabilizing liner for bags. To this end, the present invention includes a panel member that rolls up for insertion into a bag to be supported. The panel member includes means for controlling the expansion of the panel member and, accordingly, for establishing a diameter for the rolled up liner.

In a preferred embodiment, the invention includes a substantially rectangular plastic panel member that is adapted to be rolled up to form a cylinder and then inserted into a bag. Lower corners of the panel are rounded and slightly angled (as seen in FIG. 3) to prevent tearing of walls of the bag. One or more clips on an upper edge of the panel clasp and overlap the edge, and engage notches formed on the overlapped edge to secure the panel member in its desired rolled up state. The diameter of the formed cylinder can be adjusted by selective engagement of the notches with the clip.

Further, the panel member preferably includes holes through which portions of the walls of the bag are inserted so that the bag is secured to the cylinder, if necessary. Also, the panel member includes hand grips for removing the panel member from the bag.

Accordingly, an advantage of the invention is an improved bag liner.

Another advantage of the invention is a liner that can be secured in a desired rolled up state.

Yet another advantage is a liner that can be secured in a variety of rolled up states so that the cylinder thus formed is adjustable in diameter.

These and other advantages will become apparent from the following description of the preferred embodiments thereof, taken in conjunction with the accompanying drawings.

DESCRIPTION OF THE DRAWINGS

FIG. 1 is a perspective view of a liner embodying principles of the invention;

FIG. 2 is a cross-sectional view of the liner of FIG. 1;

FIG. 3 is an illustration of a panel employed to provide the liner of FIG. 1;

FIG. 4 illustrates a securing member employed with the liner of FIG. 1;

FIG. 5 is a cross-sectional view of the securing member of FIG. 4 taken along the lines V—V;

DETAILED DESCRIPTION OF THE PRESENTLY PREFERRED EMBODIMENTS

Figure 7:
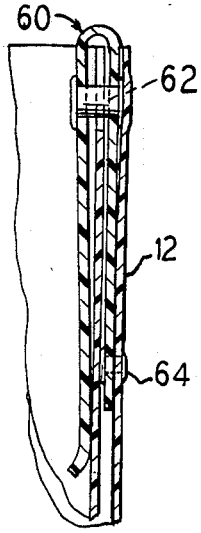
FIG. 7 is a cross-sectional view of the securing member of FIG. 6 taken along the lines VII—VII.

A liner 10 embodying principles of the invention is illustrated in FIGS. 1–3 and 11. In FIGS. 1 and 2, the liner 10 is illustrated in use.

As illustrated, the liner 10 essentially comprises a panel 12 that rolls up to fit within a bag 14. The panel 12 includes a lower edge 16 and an upper edge 18. The lower edge 16 includes rounded corners 20 so that when the liner 10 is inserted into the bag 14 or moved in adjustment, the corners 20 do not catch and tear the walls of the bag 14.

In the preferred embodiment, the width of the panel 12, i.e., the nominal distance between the top and lower edges 18 and 16, is two feet. The length of the panel 12, i.e., the distance between overlapped edge 22 and overlapping edge 24, is six feet.

The panel 12 further includes three hand grips 26 formed near the top edge 18. Each hand grip 26 include a substantially rectangular opening 28 and a U-shaped edge blunting member 30 on an upper edge 32 of the opening 28. The blunting member 30 is provided to blunt the sharpness of the edge 32 so as to provide for a more comfortable grip.

Figure 12:
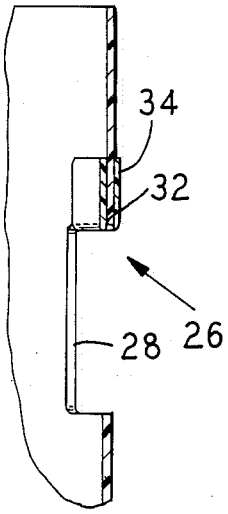
FIG. 12 is a perspective view of a hand grip formed in the liner of FIG. 1.
Figure 13:
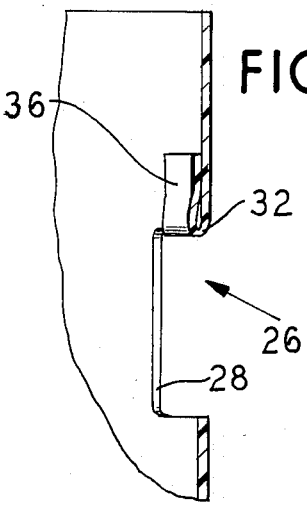
FIG. 13 is a cross-sectional/perspective view of another hand grip design.

As illustrated in FIGS. 12 and 13, the edge blunting member 30 can be formed in at least two different ways. In FIG. 12, the blunting member comprises a small panel 34 that is bent to form a clip that is U-shaped in cross-section. The clip 34 is appropriately attached to the upper edge 32 by means of adhesive, sonic welding, etc.

In FIG. 13, the blunting member 30 comprises a small panel extension 36 left over from the formation of the opening 28. The panel 36 extends downward after the formation of the opening 28 and then is folded upward along the line defined by the edge 32. The panel 36 extension then is appropriately attached to the panel 12 by means of adhesive, sonic welding, et. cetera.

Adjacent the overlapping edge 24, is located an opening 40, defined by a grommet or the like.

Figure 11:
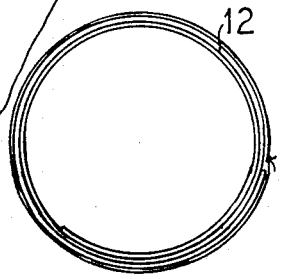
FIG. 11 is a top view of the panel of FIG. 3 in a rolled up state.

The opening 40 is employed for storage of the panel member 12. For storage, the panel member can be hung on a wall from the opening 40 cooperating element such as a nail on the wall, or the panel member 12 may be rolled-up and tied as shown in FIG. 11.

Figure 10:
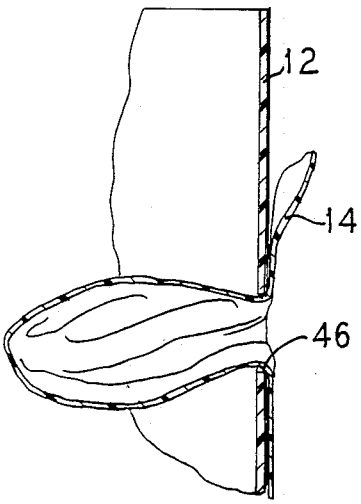
FIG. 10 is a cross-sectional view of means for securing a bag to the liner of FIG. 1.

As illustrated in FIGS. 1, 3, and 10, the panel 12 includes a plurality of openings 46 positioned near the top edge 18. The openings 46 are employed to secure the bag 14 to the panel member 12. A portion 48 of the bag 14 is shoved through an opening 46 to prevent the bag from collapsing about the panel 12, if necessary.

In the embodiment illustrated in FIGS. 1, 3, 4, and 5, the top edge 18 includes a plurality of notches 50. The notches 50 comprise V-shaped cuts along the edge 18 and are evenly distributed from the overlapping edge 24 to a predetermined distance toward the overlapped edge 22. The notches 50 are designed to cooperate with securing members 52 positioned near the overlapped edge 22. The securing members 52 and notches 50 cooperate to provide for holding the panel 12 in various rolled up states at various diameters. Accordingly, the securing members 52 and notches 50 provide for adjusting the rolled up panel 12 to a variety of diameters.

As illustrated more clearly in FIGS. 4 and 5, each securing member 52 preferably comprises a clip 54 that has a substantially U-shaped cross-section. The clip 54 is injection molded and includes a triangular shaped block 56 in between the folded leaves or clasping members **54*a* and 54*b* of the clip 54, the block 56 cooperates with the V-shaped notches 50 to lock the panel 12** in a rolled up state.

It can be appreciated that the securing member 52 cooperate with the notches 50 by grasping the overlapped portion of the panel 12 between the clasping members of the securing member 52.

Figure 6:
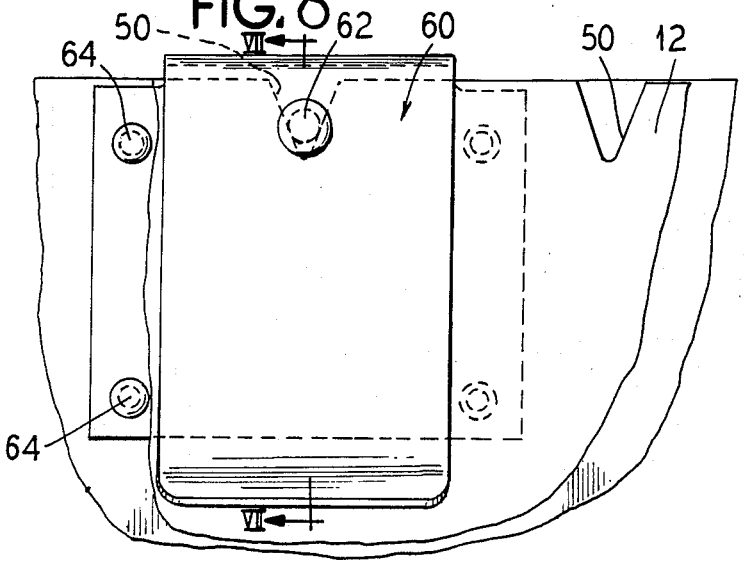
FIG. 6 illustrates another securing member that can be employed with the liner of FIG. 1.

In FIGS. 6 and 7, there is illustrated another embodiment of a securing member 60 embodying principles of the invention. The main difference between the member 60 and the member 52 is that instead of the triangular block 56, the member 60 includes a large rivet 62. Further, the securing member 60 is attached to the panel 12 by means of rivets 64 that attach a back clasping member 66 to the panel 12. Otherwise, the securing member 60 cooperates with the notches 50 by means of the rivet 62 in a fashion similar to that discussed previously. Accordingly, further discussion is not included.

Figure 9:
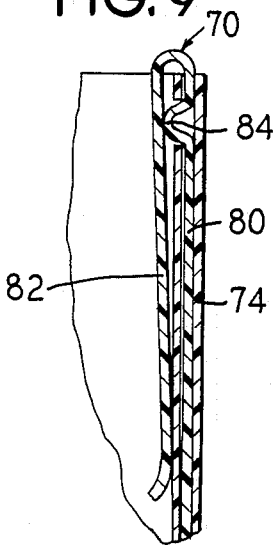
FIG. 9 is a cross-sectional view of the securing member of FIG. 8 taken along the lines IX—IX.
Figure 8:
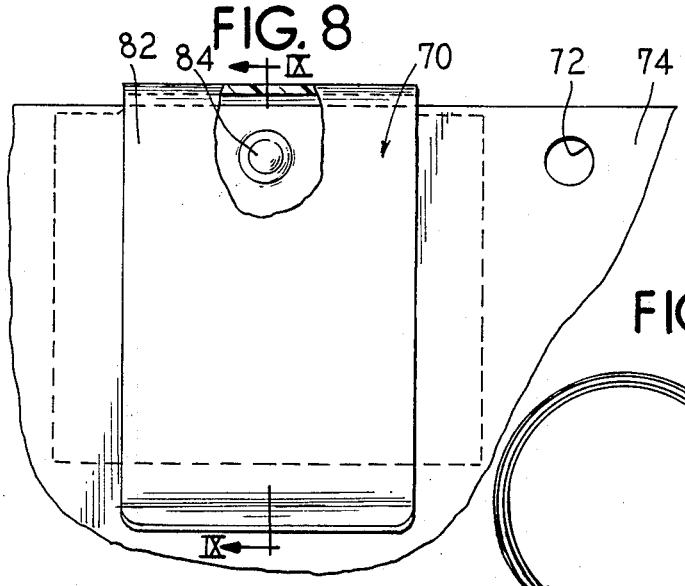
FIG. 8 illustrates another securing member that can be employed with the liner of FIG. 1.

In FIGS. 8 and 9, there is illustrated a third embodiment of a securing member 70 embodying principles of the invention. The member 70 cooperates with openings 72 formed in a panel member 74 similar to the panel member 12 to prevent unrolling of the panel 74.

The securing member 70 includes a back clasping member 80 and a front clasping member 82 integrally formed as a clip. However, the back clasping member 80 includes a dimple 84 formed therein that protrudes toward the front clasping member 82.

It can be appreciated that the dimple 84 appropriately engages one of the openings 72 so as to secure overlapped and overlapping portions of the panel 74 together. Accordingly, the cooperation between the members 70 and openings 72 operatively prevents unrolling of a rolled up panel 74 and affords selective sizing of the diameter of the cylinder formed by the rolled up panel 72.

In the embodiment discussed above, the panel member 12 preferably has a thickness of 0.03 inches and is made of polypropylene. The clip securing members preferably are dimensioned such that each back clasping member substantially comprises a three inch by two and one-half inch rectangle, while the front clasping member substantially comprises a two inch by three inch rectangle. The clasping members are formed so that the two inch wide side of the front clasping member joins, in central alignment, a three inch side of the back clasping member.

While a preferred embodiment has been shown, modifications and changes may become apparent to those skilled in the art which shall fall within the spirit and scope of the invention. It is intended that such modifications and changes be covered by the attached claims.

I claim as my invention:

1. A liner for a bag, comprising:

(a) a panel member adapted to be rolled up to form a cylinder having a top end and a bottom end, the panel member including an overlapped portion within an interior of the cylinder and an overlapping portion on an exterior of the cylinder, the cylinder adapted to be inserted within the bag; and (b) means for releasably securing the overlapped and overlapping portions together, said means for releasably securing comprising a clip attached to a top end edge of one of the overlapped or overlapping portions, said clip being formed to be substantially U-shaped in cross-section and to include two clasping members resiliently urged together, the clip further including a protruding member positioned substantially between the clasping members, the other of the overlapped or overlapping portions being received within and between the clasping members and including a catch that cooperates with the protruding member so as to receive the protruding member therein to prevent relative movement between the overlapped and overlapping portions, the clasping members clasping therebetween the other of the overlapped or overlapping portions.

2. The liner of claim 1, wherein the panel member is made of plastic.

3. The liner of claim 1, wherein the panel member includes handle grips.

4. The liner of claim 1, wherein the panel member includes means for securing a wall of a bag to said liner.

5. The liner of claim 4, wherein the means for securing the wall of the bag to the liner comprises an opening into which a portion of the bag is inserted.

6. The liner of claim 1, wherein the catch comprises notches formed in an edge of the other of the overlapped or overlapping portions.

7. The liner of claim 1, wherein the catch comprises an opening formed in the panel member near an edge of the other of the overlapped or overlapping portions.

8. The liner of claim 1, wherein the panel member includes a plurality of catches for selective sizing of the diameter of the cylinder formed by the rolled up panel member.

9. A liner for a collapsible bag, comprising:

(a) a flexible panel member capable of being rolled up to form a cylinder having a top end and a bottom end, the panel member including an overlapped portion within an interior of the cylinder and an overlapping portion on an exterior of the cylinder;

(b) means for securing the bag to the liner when the liner is inserted into the bag; and (c) means for securing the overlapped and overlapping portions together to form the cylinder including a clip attached to one portion at the top end of the cylinder, the clip being made of plastic and operatively bent so as to be substantially U-shaped in cross-section and to form two clasping members that are resiliently urged together, the clip having a protruding member formed in at least one of said clasping members and extending between said clasping members, and at least one catch formed on the other portion that cooperates with the protruding member to prevent relative movement between the portions, the clasping member clasping therebetween the other of said portions.

10. The liner of claim 9, including a plurality of catches so that the cylinder can be formed of selective diameters.

11. The liner of claim 9, wherein each catch comprises a notch formed along an edge of the panel member.

12. The liner of claim 9, wherein each catch comprises an opening formed adjacent an edge of the panel member.

13. The liner of claim 9, wherein the panel member is made of polypropylene.

14. The liner of claim 9, wherein the means for securing the bag to the liner comprises a hole through which a portion of the bag is inserted.

15. A liner for a plastic bag comprising:

(a) a substantially rectangular plastic panel member adapted to be rolled up to form a cylinder having a top end and a bottom end, the panel member having an overlapped portion within an interior of the cylinder and an overlapping portion on an exterior of the cylinder;

(b) handle grips formed in said panel member near the top end thereof by means of openings in said panel member;

(c) means for securing the bag to the liner; and (d) means for securing together the overlapped and overlapping portions including a clip attached to one portion along a top end edge thereof, said clip being formed of a resilient plastic and bent to be substantially U-shaped in cross-section and to form two clasping members urged together so as to exert a clasping force against each other, said clip further including a protruding member formed on at least one of said clasping members and extending between said clasping members, and at least one catch formed in the other of the portions, the catch comprising a suitable opening within which is received said protruding member so as to prevent relative movement between said portions, said clasping members receiving therebetween an upper edge of the of said portions.

16. The liner of claim 15, wherein the catch means comprises a plurality of notches formed along an edge of the liner.

17. The liner of claim 15, wherein the catch means comprises a plurality of openings formed adjacent an edge of the panel member.

18. The liner of claim 15, including a plurality of clips.

* * * * *